US009902188B2

(12) United States Patent
Busam

(10) Patent No.: US 9,902,188 B2
(45) Date of Patent: Feb. 27, 2018

(54) MULTI-POCKET FOLDER

(71) Applicant: ACCO Brands Corporation, Lake Zurich, IL (US)

(72) Inventor: Edward P. Busam, Mason, OH (US)

(73) Assignee: ACCO BRANDS CORPORATION, Lake Zurich, IL (US)

( * ) Notice: Subject to any disclaimer, the term of this patent is extended or adjusted under 35 U.S.C. 154(b) by 210 days.

(21) Appl. No.: 14/522,176

(22) Filed: Oct. 23, 2014

(65) Prior Publication Data

US 2015/0041526 A1 Feb. 12, 2015

Related U.S. Application Data

(63) Continuation of application No. 14/198,022, filed on Mar. 5, 2014, which is a continuation-in-part of application No. 12/264,630, filed on Nov. 4, 2008, now Pat. No. 8,702,128.

(60) Provisional application No. 61/038,868, filed on Mar. 24, 2008, provisional application No. 61/086,550, filed on Mar. 24, 2008.

(51) Int. Cl.

| | |
|---|---|
| ***B42F 7/06*** | (2006.01) |
| ***B42F 21/02*** | (2006.01) |
| ***B42D 3/18*** | (2006.01) |
| ***B42F 21/00*** | (2006.01) |
| ***B42F 11/00*** | (2006.01) |
| ***B42D 1/06*** | (2006.01) |
| ***B42D 3/00*** | (2006.01) |
| ***B42F 13/00*** | (2006.01) |

(52) U.S. Cl.

CPC ..... *B42F 7/06* (2013.01); *B42D 1/06* (2013.01); *B42D 3/006* (2013.01); *B42D 3/18* (2013.01); *B42F 11/00* (2013.01); *B42F 13/0053* (2013.01); *B42F 21/00* (2013.01); *B42F 21/02* (2013.01)

(58) Field of Classification Search

CPC ..... B42F 7/06; B42F 11/00; B42F 13/0053; B42F 21/02; B42D 1/06; B42D 3/006; B42D 3/18

USPC ..... 229/67.4, 67.1, 67.3, 72; 281/21.1, 45; 402/31

See application file for complete search history.

(56) References Cited

U.S. PATENT DOCUMENTS

| | | | | |
|---|---|---|---|---|
| 5,598,969 | A * | 2/1997 | Ong | B42F 7/06 229/67.1 |
| 6,666,610 | B1 | 12/2003 | Moor et al. | |
| 7,819,432 | B2 | 10/2010 | Rowe et al. | |
| 8,550,329 | B2 | 10/2013 | Busam et al. | |
| 2005/0156017 | A1 * | 7/2005 | Crum | B42F 7/06 229/67.1 |

(Continued)

*Primary Examiner* — Christopher Demeree

(74) *Attorney, Agent, or Firm* — Thompson Hine LLP

(57) ABSTRACT

A folder including a main panel having an inner face and an outer face, and a slash panel having an inner face and an outer face. The slash panel is coupled to the main panel such that the inner face of the main panel and the inner face of the slash panel form a first pocket therebetween. The folder further includes a first outer panel coupled to the main panel and forming a second pocket with the outer face of the main panel. The folder has a second outer panel coupled to the slash panel and forming a third pocket with the outer face of the slash panel. The main panel, the slash panel, the first outer panel and the second outer panel are all made of a single unitary piece of material.

31 Claims, 16 Drawing Sheets

(56) References Cited

U.S. PATENT DOCUMENTS

| | | | | |
|---|---|---|---|---|
| 2011/0073638 | A1* | 3/2011 | Grassia | B42F 7/06<br>229/67.1 |
| 2011/0210022 | A1* | 9/2011 | Degel | A45C 1/06<br>206/232 |
| 2014/0191021 | A1 | 7/2014 | Busam | |

* cited by examiner

MULTI-POCKET FOLDER

This application is a continuation of U.S. patent application Ser. No. 14/198,022, filed on Mar. 5, 2014, which is a continuation-in-part of U.S. Pat. No. 8,702,128, issued on Apr. 22, 2014, which in turn claims priority to U.S. Provisional Application No. 61/038,868, filed Mar. 24, 2008, and U.S. Provisional Application No. 61/086,550, filed Aug. 6, 2008. The entire contents of all four of these documents are hereby incorporated by reference.

The present application is directed to a folder with pockets.

BACKGROUND

Bound devices, such as notebooks, are used to store and dispense paper and other items. Such bound devices may include a pocket or the like to store loose components. However, existing pocket may not be sufficiently convenient to use, and may be difficult to manufacture.

SUMMARY

In one embodiment, the invention is a folder with multiple pockets. More particularly, in one embodiment the invention is a folder including a main panel having an inner face and an outer face, and a slash panel having an inner face and an outer face. The slash panel is coupled to the main panel such that the inner face of the main panel and the inner face of the slash panel form a first pocket therebetween. The folder further includes a first outer panel coupled to the main panel and forming a second pocket with the outer face of the main panel. The folder has a second outer panel coupled to the slash panel and forming a third pocket with the outer face of the slash panel. The main panel, the slash panel, the first outer panel and the second outer panel are all made of a single unitary piece of material.

DETAILED DESCRIPTION

Figure 1:
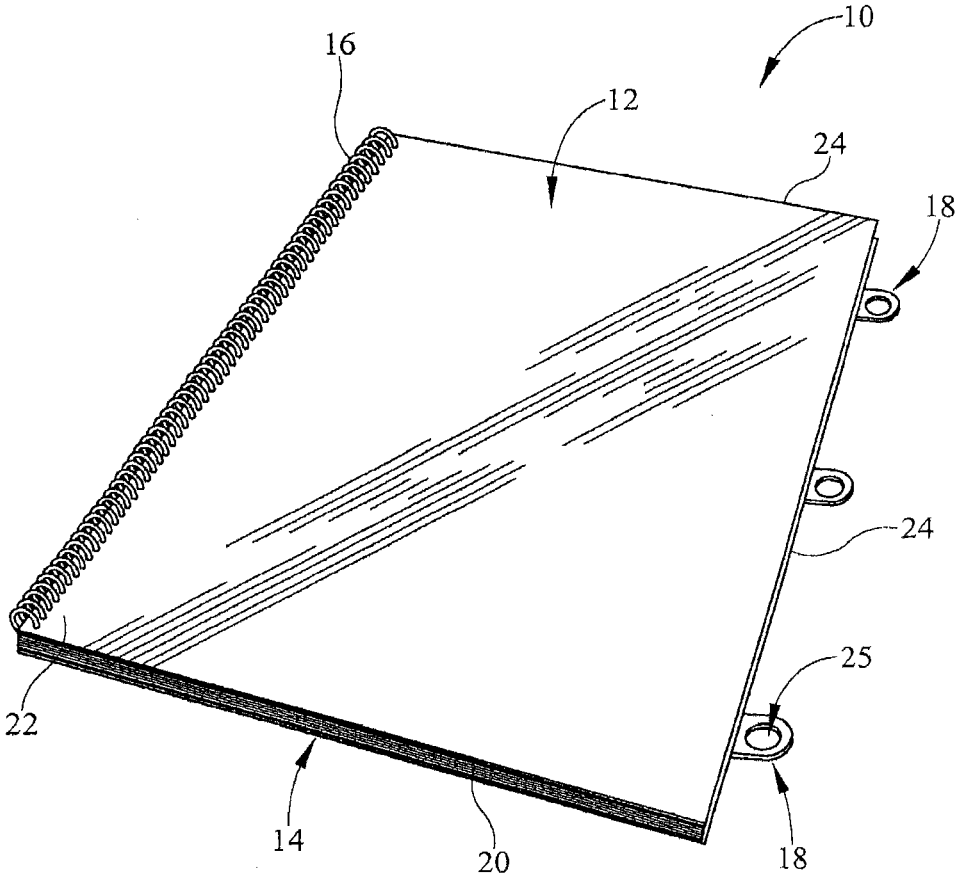
FIG. 1 is a front perspective view of a bound component incorporating a set of tabs along a side thereof.
Figure 2:
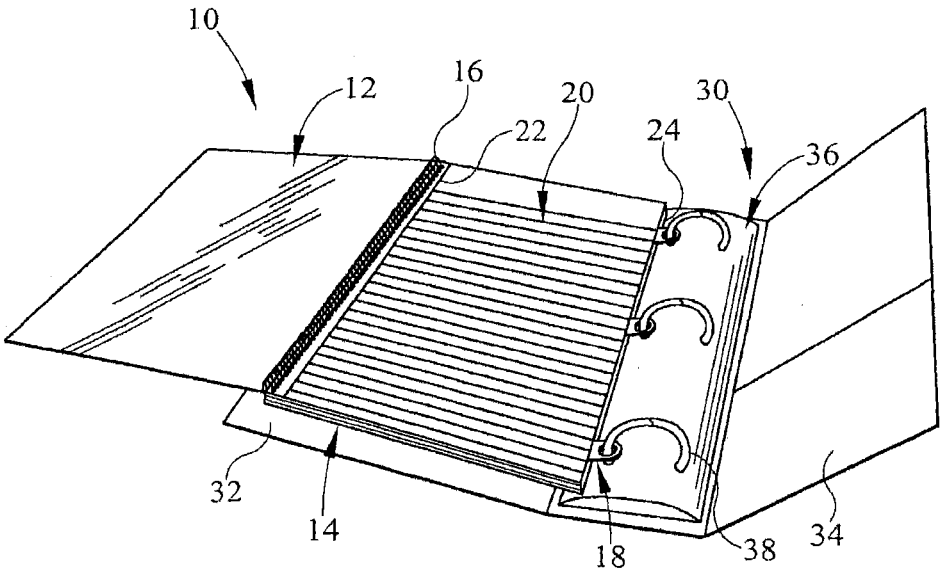
FIG. 2 is a front perspective view of the bound component of FIG. 1, show in an open position and bound to a binder.

As shown in FIG. 1, a bound component, generally designated 10, may include a first cover/divider 12, a second or supplemental cover/divider 14, a binding mechanism or binding device 16. The bound component 10 may include at least one tab/binder attachment tab/projection 18 extending from one or more of the covers 12, 14. The bound component 10 may be a polygonal (in one case, three or four sided) component that includes at least one pivot point and/or hinge line (in one case, defined by or along the binding mechanism 16). The pivot/hinge can enable a user to open the bound component 10 and thereby access, view, retrieve, or otherwise employ the inner contents of the bound component 10 while the bound component 10 remains linked to a binding device, such as a multi-ring binder or binding device 30 (FIG. 2). By way of example, the bound component 10 may be a notebook, planner, journal, diary, notepad, folder, divider, pocket, portfolio, binder, a covered calculator, a foldable case (e.g., for holding pens/pencils), etc. The bound component 10 may further include a plurality of papers, sheets, or pages (collectively termed "pages" herein) 20 bound by the binding mechanism 16 that are positionable between the coves 12, 14.

Figure 3:
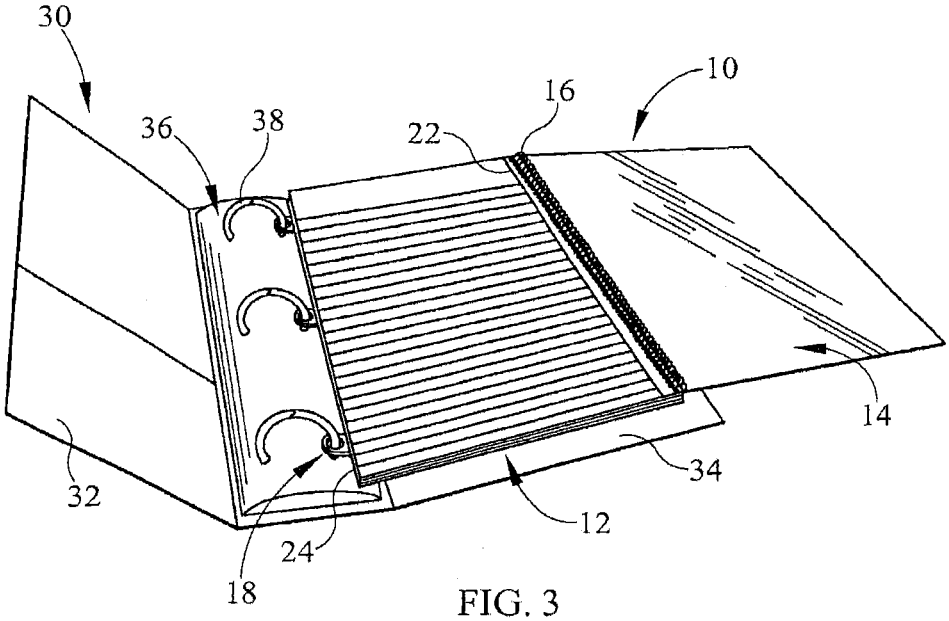
FIG. 3 is a front view of another bound component, shown in an open position and bound to a binder.

Referring to FIGS. 2 and 3, the bound component 10 may be removably attachable to the multi-ring binder 30 by the binder attachment tabs 18 associated with the first cover 12 and/or second cover 14. The multi-ring binder 30 may include a first binder cover 32, a second binder cover 34, a binder spine 36, and a plurality of binder rings 38. The binder rings 38 can take the form of traditional circular clip rings or, in the alternative, binder straps, hinged clips, or any other form of a releasable binder mechanism.

The first cover 12 and the second cover 14 together may serve as front and back covers for the bound component 10, with either cover 12, 14 being able to serve as a front or back cover, depending on the desired use and application. Additionally, it is to be understood that only a single cover may be employed in certain circumstances, and that the first and/or second cover 12, 14 could be used as a divider positioned in the middle of the thickness of the bound component 10, and not necessarily as a front or back cover, per se. The first and second covers 12, 14 may be made of a variety of materials, including but not limited to paper board (e.g., coated or uncoated natural kraft board, natural kraft paper), cardboard, plastic or polymers, (e.g., polypropylene), polymer covered paperboard or cardboard, leather, metal, felt, composites, or other suitable materials such that the covers 12, 14 are, in one case, thicker and/or stiffer then the pages 20 to protect the pages 20 and allow the covers 12, 14 to be easily visually and/or tactilely located.

Each cover 12, 14 may be generally the same size and shape as the pages 20, or shaped and sized slightly larger than the pages 20 to generally cover an outer one of (i.e. the top or bottom, as appropriate) of the pages 20 when the cover 12, 14 is in a closed position to thereby protect the pages 20 (see FIG. 1 wherein both the covers 12, 14 are in their closed positions). In the illustrated embodiment the covers 12, 14 are made of separate pieces of material and are indirectly coupled together by the binding mechanism 16, and thus are spaced apart from and not directly coupled together. However, if desired the covers 12, 14 can be made from the same single piece of material.

The binding mechanism 16 can take any of a variety of forms and may, for example, be a more or less permanent fixture (i.e. such that the pages 20 are torn when removed) such as a wire (e.g., twin or spiral) coil, sewn binding, book-style binding, plastic clip, or a metal, wire, or plastic clip (e.g., a report binder), so long as the binding mechanism 16 can in some cases be configured for acting as a pivot/hinge location for the covers 12, 14 and pages 20. It is also to be recognized that the binding mechanism 16 could be covered (e.g., a covered spiral binding device) or uncovered.

The bound component 10, each first and second cover 12, 14, and the pages 20 may each include an inner bound edge 22, which is bound by the binding mechanism 16 (or along which the bound component 10 is bound), and at least one opposite unbound or free edge 24. Each edge 22, 24 may extend at an angle (ninety degrees in the illustrated embodiment) relative to the other adjacent edges. In particular, a bound edge 22 may be directly fastened or otherwise linked to the binding mechanism 16 positioned adjacent thereto, in contradistinction to a given free edge 24 which is positioned distant from/further from the binding mechanism 16, or extends away from the binding mechanism 16. Thus, for example, when the bound component 10 is a rectangular notebook, the notebook 10 (and each bound component) may include one bound edge 22 and three free edges 24. In the illustrated embodiment, the binding mechanism 16 extends generally an entire length of the bound edge 22.

The binder attachment tabs 18 may be associated with any free edge 24 of either one, or both, of the first and second covers 12, 14. Such binder attachment tabs 18 may facilitate the attachment or linkage of a first or second cover 12, 14 with a respective binder ring(s) 38. In one case the binder attachment tabs 18 are positioned on an opposite side of the cover 12, 14 relative to the binding mechanism 16/bound edge 22. Each such binder attachment tab 18 may have at least one respective tab hole or opening 25 formed therein, through which a binder ring 38 may be received and thereby joined with a respective binder attachment tab 18. Each cover 12, 14 may include a plurality of discreet spaced-apart tabs 18 extending outwardly from an associated free edge 24 (when deployed), and the cover 12, 14 may lack any structure positioned between each deployed tab 18 in a direction generally parallel to the associated free edge 24 (i.e. such that a gap is present between each tab 18).

As seen from FIGS. 2 and 3, upon joinder of at least one binder ring 38 with a corresponding binder attachment tab 18, the bound component 10 and the multi-ring binder 30 may thereby be attached/interconnected. In one case there is a one-to-one ratio between the binder rings 38 and tabs 18 such that each ring 38 is received through a tab 18, and each tab 18 receives a ring 38 therethrough. Further notable is the placement of the binder attachment tabs 18 in a manner so that they may extend from a free edge 24. In the example of FIGS. 2 and 3, the bound component 10 may be side-bound, with the bound edge 22 being adjacent the side-mounted binding mechanism 16 and with the free edge 24, with which the binder attachment tabs 18 are associated, being parallel and opposed relative to the bound edge 22. Due to the configuration/placement of the binder attachment tab(s) 18 (i.e., being placed away from a bound edge 22/binding mechanism 16), pivot locations of the binding mechanism 16 of the bound component 10 and the binder 30/binder rings 38 may, essentially, not coincide (i.e., interference therebetween is thereby avoidable).

By avoiding the coincidence of such pivot locations with the tabs 18, the binding mechanism 16 of the bound component 10 may have a free range of motion, limited only by, e.g., the surface (not shown) upon which it rests and not by the binder rings 38. In one case, for example, even when bound in place each page 20 (and the cover 14 in the embodiment of FIGS. 1-3) is pivotable by at least about 180 degrees relative to a plane defined by the cover 12. Accordingly, the bound component 10 may, due to such construction, may be folded out flat, even while attached to the multi-ring binder 30. Thus, it is to be understood any pivot-based item (e.g., the bound component 10, a folder, etc.) may benefit from the use of the appropriately placed binder attachment tabs 18, as described herein, to allow such item to be folded out flat. Further, if the bound component 10 is, for example, a notebook, pages can be removed therefrom (i.e., by tearing the pages 20 from the binding mechanism 16) even while the notebook is mounted in the multi-ring binder 30, without creating additional tear locations due to the binder rings 38.

Figure 4:
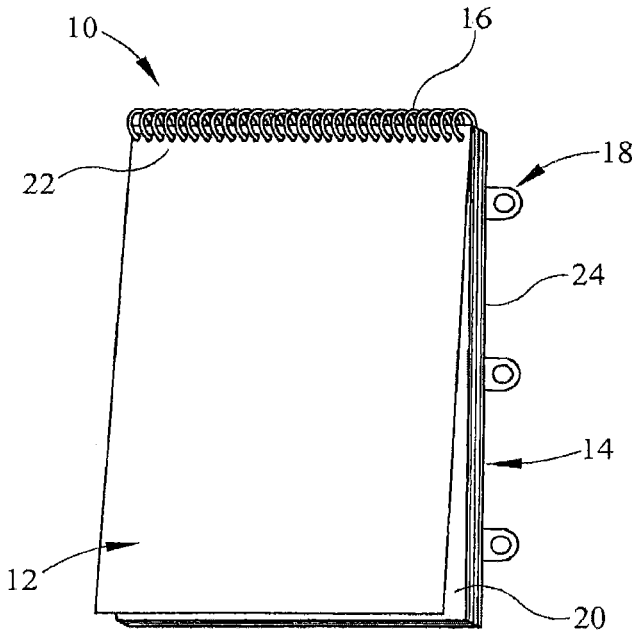
FIG. 4 is a top view of another bound component notebook, bound along its top edge with a set of tabs along a side thereof.

In addition to the arrangement shown in FIGS. 2-3, the avoidance of the coincidence of the pivot locations may also be achieved by, for example, placement of the binding mechanism 16 at the top of the bound component 10, as shown in FIG. 4, and having the binder attachment tab(s) 18 extend from a free edge 24 adjacent to and perpendicular to the bound edge 22/binding mechanism 16. It is to be understood that the free edge 24 could be any edge other than the edge 22 containing or extending adjacent to the binding mechanism 16. For example, the free edge 24 could be, with reference to the embodiment of FIG. 4, a right, left or bottom edge.

Figure 5:
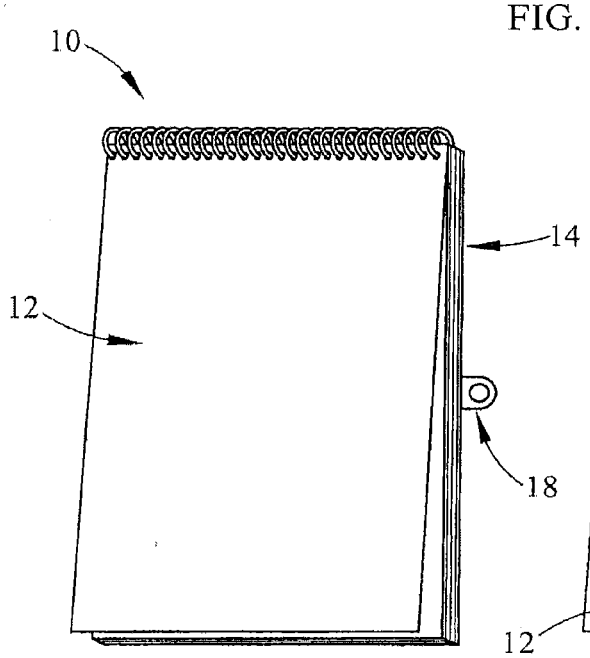
FIG. 5 is a top view of a first variation of the bound component of FIG. 4, with a single binder attachment tab.
Figure 6:
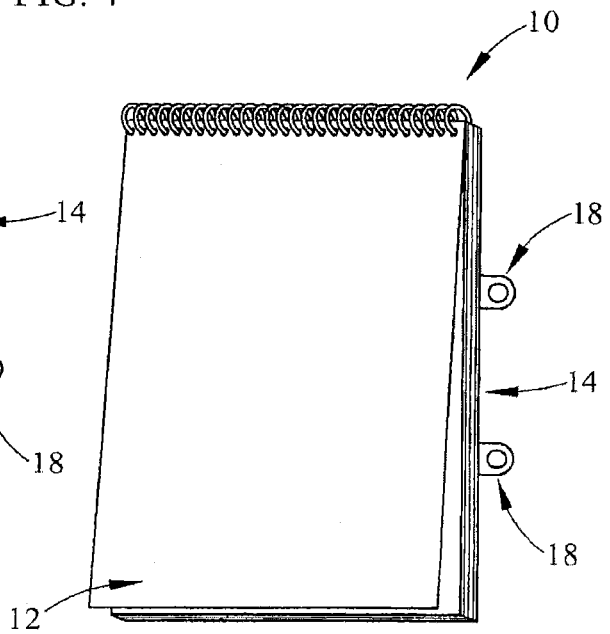
FIG. 6 is a top view of a second variation of the bound component of FIG. 4, with two binder attachment tabs.
Figure 7:
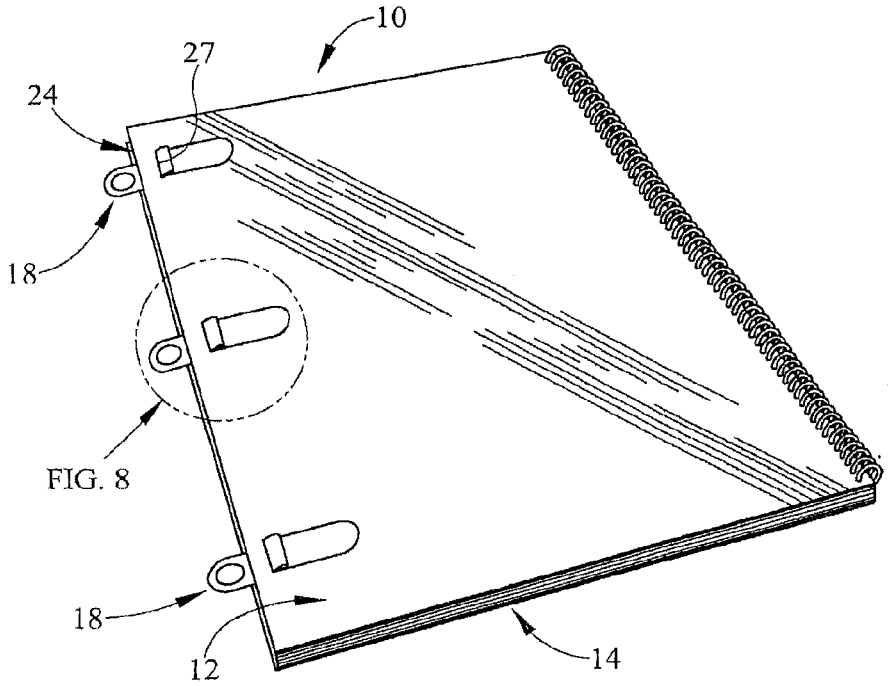
FIG. 7 is a front perspective view of another bound component, in which the cover incorporates foldable binder attachment tabs.
Figure 8:
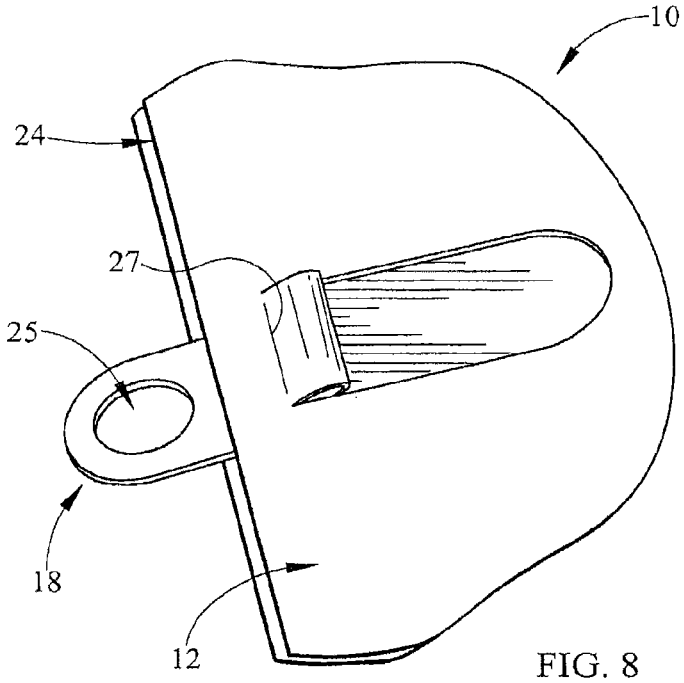
FIG. 8 is an enlarged perspective view of the region indicated in FIG. 7.

FIGS. 5 and 6 further illustrate that a first cover 12 may include any of a various number of binder attachment tabs 18, including at least one. It is further understood that the associated second cover 14 could be similarly constructed.

Additionally, although each binder attachment tab 18 is shown with one tab hole 25, it is to be understood that each attachment tab 18 could accommodate more than one such tab hole 25 therein, e.g., to accommodate two or more binder rings 38, such as in an instance in which two or more binder rings 38 are rather closely spaced (e.g., in one case, within about 1-2 inches), or for other reasons or arrangements.

One of ordinary skill in the art will further recognize that the exact size and shape of a binder attachment tab 18 may be chosen to suit the application, e.g., based on needed strength, aesthetics, etc. Further, the particular placement of the binder attachment tabs 18 may be chosen to suit the application, e.g., given the number and/or placement of the binder rings 38 to which the tabs 18 may be bound. Additionally, it is to be understood that the binder attachment tabs 18, in addition to being incorporated/attached to a bound component 10 by a manufacturer or secondary producer, could be provided separately to consumers for attachment to a bound component 10 not initially provided therewith (i.e., via retrofitting), and be attached by adhesives, hook-and-loop fasteners, mechanical attachments, etc.

FIGS. 7-14 illustrate various embodiments for the connection of the binder attachment tabs 18 to a first or second cover 12, 14 (with only a first cover 12 shown, for simplicity). As per the particular embodiment shown in FIGS. 7-11, each binder attachment tab 18 may be integrally formed within the first cover 12 at a position near but spaced away from an associated free edge 24. In particular, a binder attachment tab 18 may be initially defined by a weakened, semi-weakened or tearable (e.g., selectively thinned or perforated) boundary or boundary line 26, which is more easily tearable than other adjacent areas, or along which the cover 12/14 is predisposed to tear (all collectively termed a "tear guideline" herein). Alternatively, the boundary line 26 can take the form of fully-formed cuts that extend through the thickness of the cover 12, 14 along the entire length of the boundary line 26.

Figure 9:
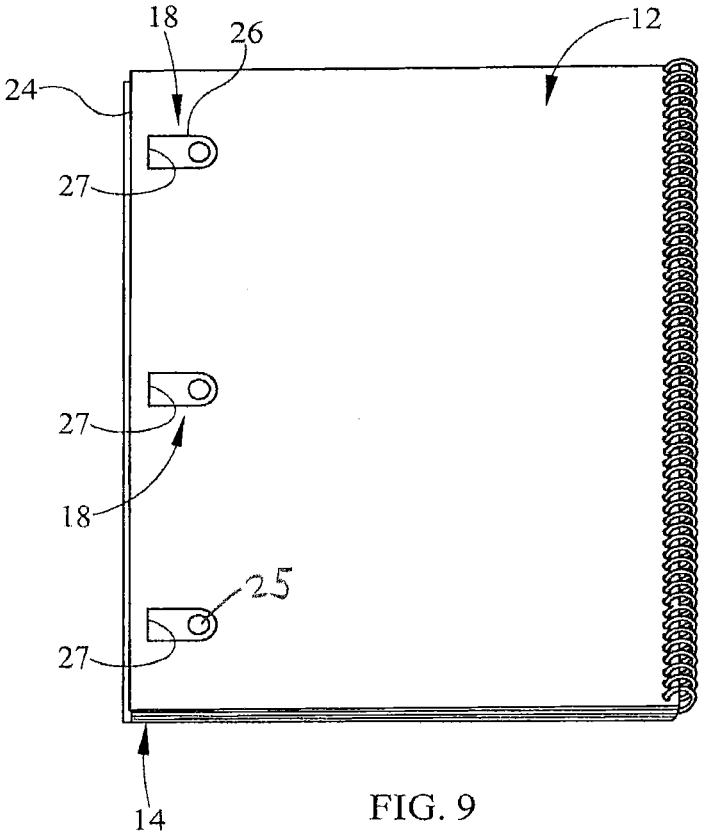
FIG. 9 is a top view of the bound component of 7, with the binder attachment tabs in their retracted positions.

The binder attachment tab 18, as thus initially provided, may provide a perimeter edge, pivot line or fold line 27 not compromised by any perforation/area of weakness, and/or stronger than the areas defined by the boundary line 26. FIG. 9 shows a tear guideline 26 in a sideways "U"-shape, but the tear guideline 26 can take over of a variety of other shapes, such as a 3-sided block, star, or any other shape so long as there is one non-perforated/non-weakened edge or line 27, etc. This non-weakened edge 27 thereof may thereby define a tab fold line 27 of a corresponding binder attachment tab 18. Thus, in the present context, "semi-weakened" may more particularly refer to the boundary 26, as a whole, indicating only a portion thereof is weakened relative to the rest of the cover 12 and not necessarily implying the degree of weakening of such a portion. Additionally, in this embodiment, the first or second cover 12, 14 and the corresponding binder attachment tabs 18 may be formed of a same material.

The tab fold line 27 may be parallel to a corresponding free edge 24 to permit the associated binder attachment tab 18 to fold out in a direction perpendicular to the corresponding free edge 24, extending beyond the free edge 24. Alternatively, the tab fold line 27 and, further optionally, the orientation of the boundary 26, may be angled relative to a corresponding free edge 24 to yield a complementarily angled fold of an associated binder attachment tab 18. This alternative may allow a binder attachment tab 18 to be located more to the interior of a first or second cover 12, 14 and still reach a position more toward an outer extremity of the particular first or second cover 12, 14.

Additionally, it is to be understood that at least the area proximate a tab fold line 27 (both in the binder attachment tab 18 and the corresponding cover 12, 14 but not on the boundary 26) may be reinforced on one or both faces thereof by any of a variety of means. Potential reinforcement mechanisms include, for example, a backing tape (such as MYLAR® tape, i.e., a thin strong polyester film); a reinforcing filler mixed into the pulp, when the cover 12, 14 is made using a paper board material; a further coating; a separately attached substrate material (e.g., paper board or plastic); and/or a folded-over edge (i.e., creating double thickness in region to be reinforced), or other strengthening materials.

Once a binder attachment tab 18 is folded or punched out along the boundary 26, it may be folded (e.g. manually) outwardly along the tab fold line 27, toward, and ultimately beyond, the corresponding free edge 24 to it extended or deployed position. Accordingly, the binder attachment tab 18 of this embodiment may be designed to be of a sufficient length to extend, upon deployment thereof, from an interior position of the first or second cover 12, 14, across the proximate free edge 24, and then out to a location that may permit total exposure of/access to the opening 25 and connection of the binder attachment tab 18 with a corresponding binder ring 38. When use of the binder attachment tab 18 is no longer desired, the binder attachment tab 18 can be folded back to its original retracted/undeployed/unextended position within the cover 12/14.

One of ordinary skill in the art will recognize that any such binder attachment tab 18 could be folded toward the back or front of a first or second cover 12, 14 to be deployed in the desired fashion. Yet further, although not expressly shown, a mechanism by which a binder attachment tab 18 may be held in place, in its extended (deployed) and/or retracted position, may also be provided. That retaining mechanism could be, for example, in the form of a notch, a loop, an adhesive surface, a hook and loop fastener, etc., located on the tab 18 and/or body of the cover 12, 14.

Figure 10:
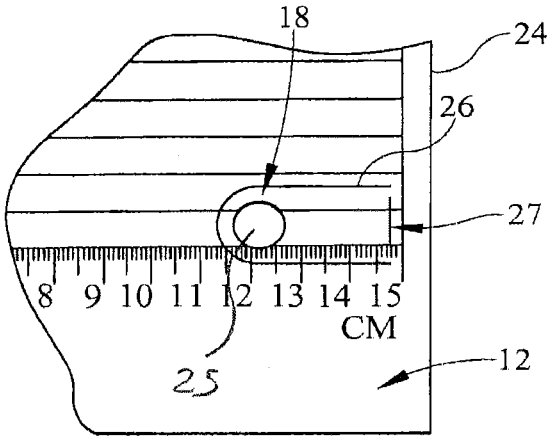
FIG. 10 is a partial bottom view of the cover of the bound component of FIG. 7, illustrating printing on the inner surface of the cover in the region of a binder attachment tab.

As shown in FIG. 10, printing or indicia (e.g., a ruler scale in the example shown) may be provided on the associated cover 12/14 and on or in the region of a punch-out binder attachment tab 18, on either or both sides thereof. Such printing can, potentially, be arranged so as to remain or become viewable after the associated binder attachment tab 18 is deployed. One possible means to provide or preserve such printing, displayed perhaps on the inside of a cover 12/14, would be to provide a cover 12/14 having two sides, where the internal side of the cover 12/14 does not have a perforated binder attachment tab and the outer layer does have a perforated binder attachment tab 18. With such a structure, the internal side of the cover 12/14 may be loosely connected around the overlapped region of the printing, on the internal side of the cover 12/14, and the binder attachment tab 18 as perforated on the outside of the cover. Designed as such, the binder attachment tab 18 may be able to fold in either direction, to the outside or to the inside sliding between the internal and outer layers of the cover 12/14 and protruding from the cover 12/14 through an opening on the cover's edge. It is to be understood that in such a design the tabs 18 would be deployed 18 without disrupting the internal printed material. It is to be understood that such printing could be provided on either/both faces of a first or second cover 12, 14. Likewise, the printing could, for example, be similarly be provided on both the first and second covers 12, 14, thereby being available for viewing on a cover 12, 14 for which a printing-proximate binder attachment tab 18 is not deployed.

Figure 11:
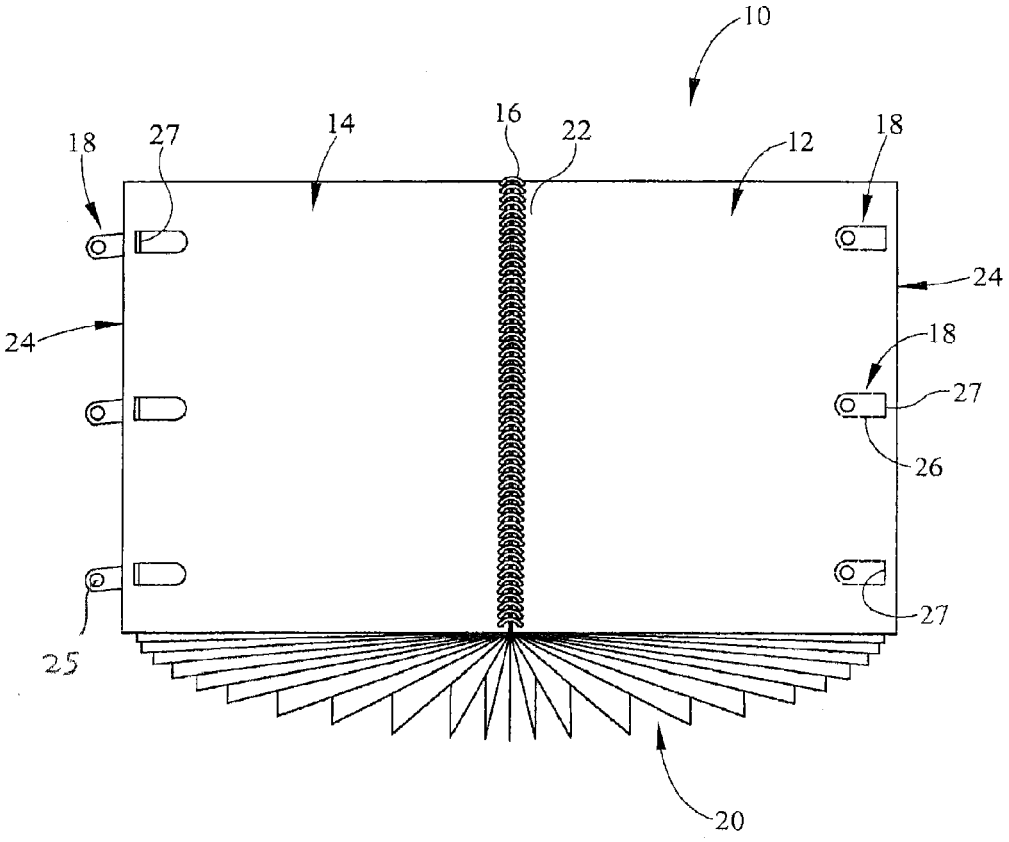
FIG. 11 is a bottom view of a bound component incorporating the cover shown in FIG. 7, showing a plurality of binder attachment tabs associated with each respective cover and illustrating the selectively deployable nature thereof.

Referring to FIG. 11, the bound component 10 using the tab 18 arrangement of FIGS. 7-10 may include first and second covers 12, 14, with each having at least one binder attachment tab 18 associated therewith. Since the first and second covers 12, 14 each have at least one respective binder attachment tab 18, the user may choose which, if any, of the binder attachment tabs 18 should be deployed on a cover 12, 14 at any given time. By way of example only, the binder attachment tabs 18 of the second cover 14 might be deployed, while those of the first cover 12 may be left undeployed. It is to be understood also that the bound component 10, as shown, may generically define a pivotable stationery item or bound component. As such, the tab embodiment of FIGS. 7-11 may also be employed with, e.g., a folder, bound component or another pivoting stationery item, or other items as outlined above.

Figure 12:
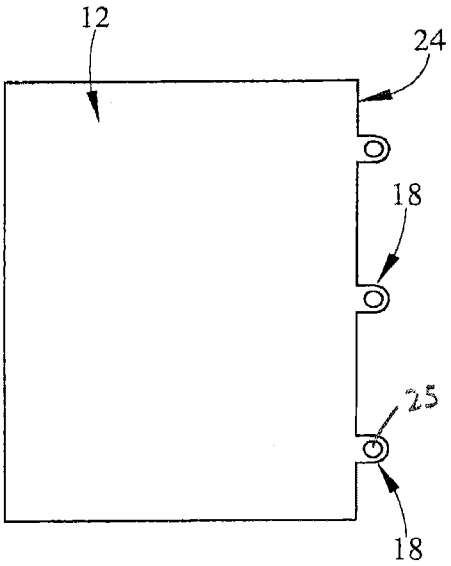
FIG. 12 is a top view of a cover with integral binder attachment tabs.
Figure 13:
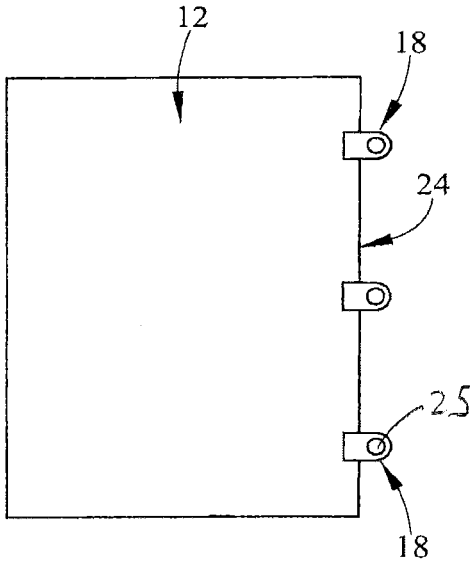
FIG. 13 is a top view of a cover with binder attachment tabs that are adhered or otherwise attached thereto.
Figure 14:
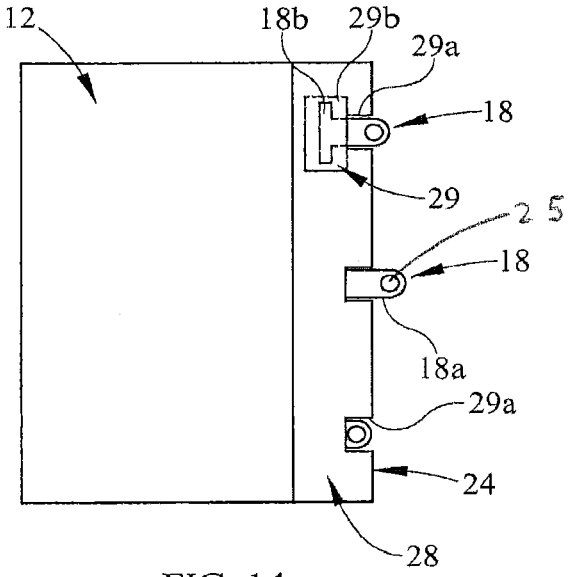
FIG. 14 is a top view of a cover with sliding, retractable binder attachment tabs.
Figure 15:
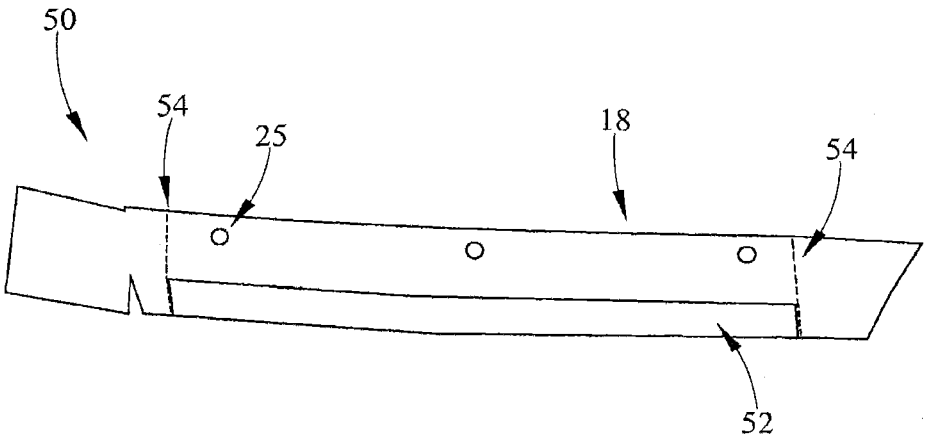
FIG. 15 is a top perspective view of another embodiment of the binder attachment tab, similar to the cover of FIG. 13, in which a peel-off strip is removable to expose an adhesive, and in which perforations are provided to enable separation of the binder attachment tab from a cover, a board, an extended strip containing one or more similar binder attachment tabs, or some other source.

Other tab embodiments may be utilized, as shown in FIGS. 12-14. Referring to FIG. 12, in the illustrated embodiment the binder attachment tabs 18 extend integrally from a free edge 24 of a first or second cover 12, 14. In this case, each tab 18 is integrally or unitarily, and seamlessly, formed from a single piece of material with the rest of the cover 12. In addition, the cover 12 may be substantially continuous adjacent to each tab 18; i.e. the cover 12, 14 may lack any openings or the like adjacent to each tab 18 to ensure that the cover 12, 14 has sufficient strength and structural integrity adjacent to the tabs 18. For example, in one embodiment each tab 18 has a tab width measured generally perpendicular to the associated edge (edge 24 in the embodiment of FIG. 12), and the cover 12, 14 lacks any openings or the like (that are not located in the tabs 18 themselves) located a distance less than a tab width from any of the tabs 18.

Each tab 18 may be seamlessly connected to a main body of the cover 12, 14 such that the cover 12, 14 lacks any seam, hinge or pivot line positioned between the tab 18 and the main body of the cover 12, 14. The lack of seams, hinge or pivot lines may reduce the chances of the tab 18 being torn off, and may make it easier to pivot the bound component 10 about the rings 38 of the binder 30 since the tabs 18 do not lag behind when the bound component 10 is pivoted about the rings 38.

It is to be understood that any various means or processes (e.g., cutting, gel molding, injection molding, net-shape manufacturing, and/or another known production process) for producing an integral set of binder attachment tabs 18 may be used to form the embodiment shown in FIG. 12. Like in the earlier tab embodiments, the first or second cover 12, 14 and the corresponding binder attachment tabs 18 may be formed of a same material (e.g., paper board, plastic, etc.). Further, such a binder attachment tab 18 may have any size, shape, placement, number of tab holes 25, etc., as deemed necessary.

Another tab embodiment, as shown in FIG. 13, may utilize binder attachment tabs 18 that are attached to the body of the cover 12, 14 proximate a free edge 24 of a first or second cover 12, 14. Such attachment may be achieved by, for example, an adhesive (e.g., glue, tape, etc.) and/or a mechanical means (e.g., staples, rivets, stitching, sewing, hook and loop fasteners (e.g., VELCRO® fastening material), etc.). The degree of permanence desired for such attachment may be achieved by the chosen fastening/attachment means. In this case the binder attachment tabs 18 are not unitarily or integrally formed as a single piece of material with the remainder of the associated cover 12/14.

A rivet or single point may be used to secure the attachment tabs 18, which offers the benefit of a pivotable attachment, thereby permitting the angle of a binder attachment tab 18 to be radially adjusted, and effectively permitting selectable pivotable retraction and/or lateral/angular positioning thereof relative to any binder ring 38. If a rivet is used, for example, as the attachment mechanism and the binder attachment tab 18 is further provided with a longitudinally-extending rivet engagement slot (not shown), selectable slide and pivot (i.e., X, Y, theta) positioning of the tab 18 may be possible. It should be, likewise, understood that other attachment means may be utilized that would otherwise facilitate linear and/or rotational adjustment for the tabs 18. Other means for adjusting the effective length of a binder tab 18 could be utilized.

Furthermore, it is to be understood that the binder attachment tabs 18, as provided in the embodiment of FIG. 13, could be mounted by the initial manufacturer, a secondary production facility, and/or an end user, and such binder attachment tabs 18 do not necessarily have to be made of the same material as the first and/or second cover 12, 14.

Another embodiment, as illustrated in FIG. 14, may allow for a slide-mount of the binder attachment tabs 18. In this embodiment the first or second cover 12, 14 may incorporate an additional slide accommodation strip 28 attached thereto along a free edge 24. The first or second cover 12, 14 and the slide accommodation strip 28 together may define a retractable slide zone 29. The retractable slide zone 29 may include a relatively narrow neck or slide adjustment notch 29*a* adjacent to the free edge 24 and a relatively wide slide retaining region 29*b* spaced away from the free edge 24. The binder attachment tabs 18 of this embodiment may include a relatively narrow main tab extension 18*a* adjacent to the tab hole 25 (received in the slide adjustment notch 29*a*) and a relatively wide tab retaining portion 18*b* spaced away from the tab hole 25 (received in the slide retaining region 29*b*).

The slide retaining region 29*b* accommodates the sliding of the tab retaining portion 18*b*. As such, the slide retaining region 29*b* may have a width permitting the slide fit of a respective tab retaining portion 18*b* therein. Additionally, the slide retaining region 29*b* may have a depth sufficiently exceeding that of the respective tab retaining portion 18*b* to permit lateral adjustment of the respective main tab extension 18*a* relative to a free edge 24. Given that the width of the slide retaining portion 29*b* may be much greater than a corresponding main tab extension 18*a* and/or slide adjustment notch 29*a*, the tab embodiment of FIG. 14 may allow for retractable/extendable slide positioning of a binder attachment tab 18, of which three different slide positions are shown in FIG. 14. As will be appreciated by one of ordinary skill in the art, slide-mounting of the binder attachment tabs 18, in general accordance with this embodiment, may permit for any of a variety of effective tab lengths to be chosen (i.e., allowing distance from the binder rings 38 to be adjusted).

The slide adjustment notch 29*a* may extend through both the slide accommodation strip 28 and the respective first or second cover 12, 14, or through just one of the two. The slide adjustment notch 29*a* may facilitate the manual positioning of a main tab extension 18*a* to the desired location relative to the corresponding free edge 24. Finally, it is to be understood that the materials used for the first or second cover 12, 14, the binder attachment tabs 18, and/or the slide accommodation strip 28 may be any of the materials set forth above for the covers 12, 14. Additionally, the binder attachment tabs 18 could instead be incorporated in a separately produced insert unit that could then be attached to a first or second cover 12, 14, or such binder attachment tabs 18 could be sandwiched between a pair of boards (e.g., slide accommodation strip 28) and pulled out from therebetween.

Additionally, it is to be understood that further variations on the above-mentioned versions and embodiments may be possible. For one, each of the various embodiments of the binder attachment tabs 18 may be further reinforced on one or both faces thereof by any of a variety of means, as outlined above.

In addition, the cover 12, 14 and/or the bound component 10 may be provided with pockets (e.g., open or zippered; not shown) to facilitate storage/carrying of various items, such as calculators, cell phones, PDAs, pens, pencils, scissors, sticky notes, erasures, note pads, etc. Further, in each of the variations and embodiment, it is to be understood that the tab holes 25 may be formed so as to be only partially pre-formed or defined, and able to be selectively punched out (e.g., initially perforated within a given binder attachment tab 18). Finally, it is contemplated that the first or second cover 12 could serve as a cover, divider, backing, etc., so long as such is generally used in the context of provided herein.

Figure 16:
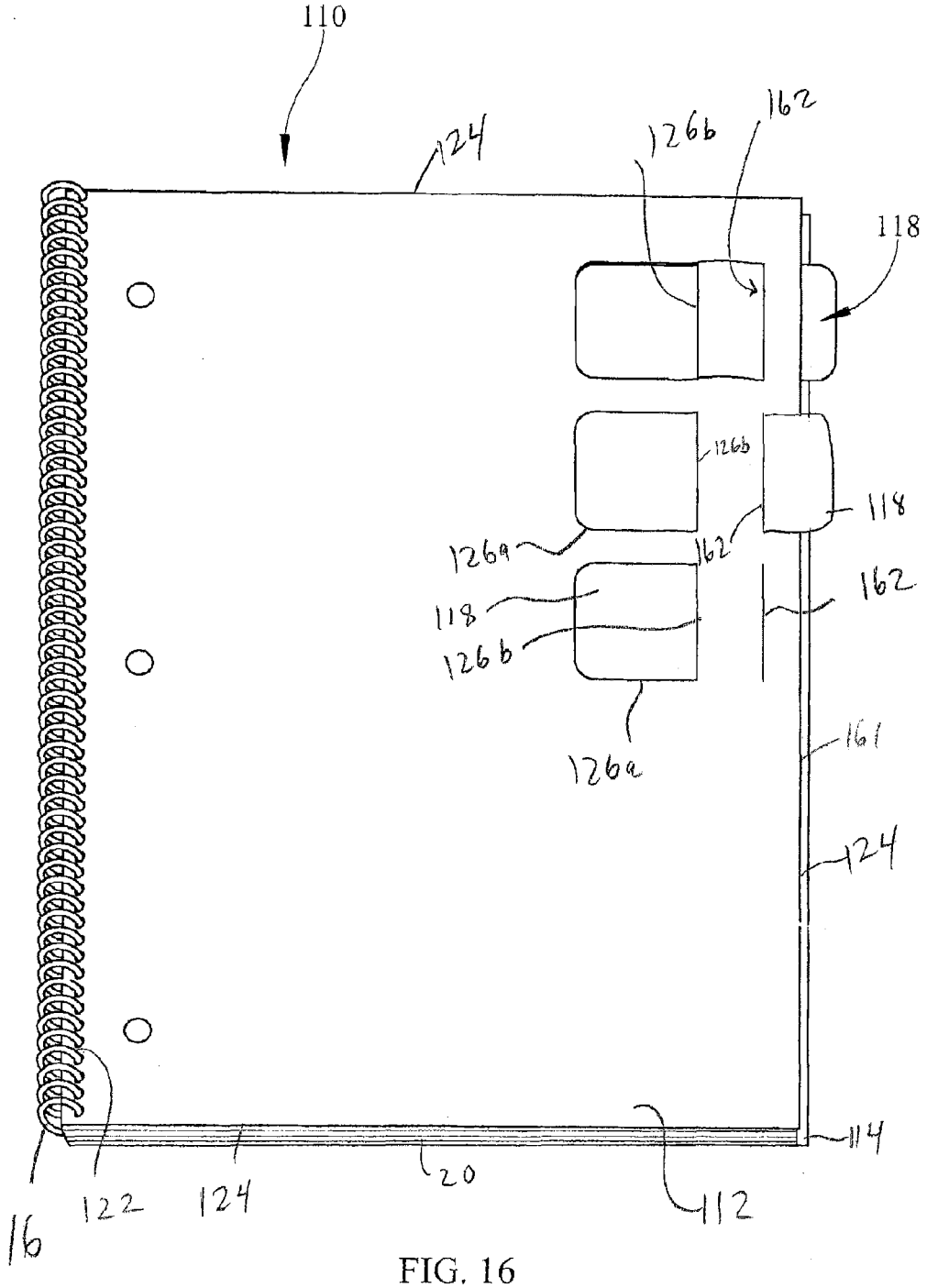
FIG. 16 is a top view of a bound component, including a cover with selectively deployable tabs, two of which are shown in their deployed position.
Figure 21:
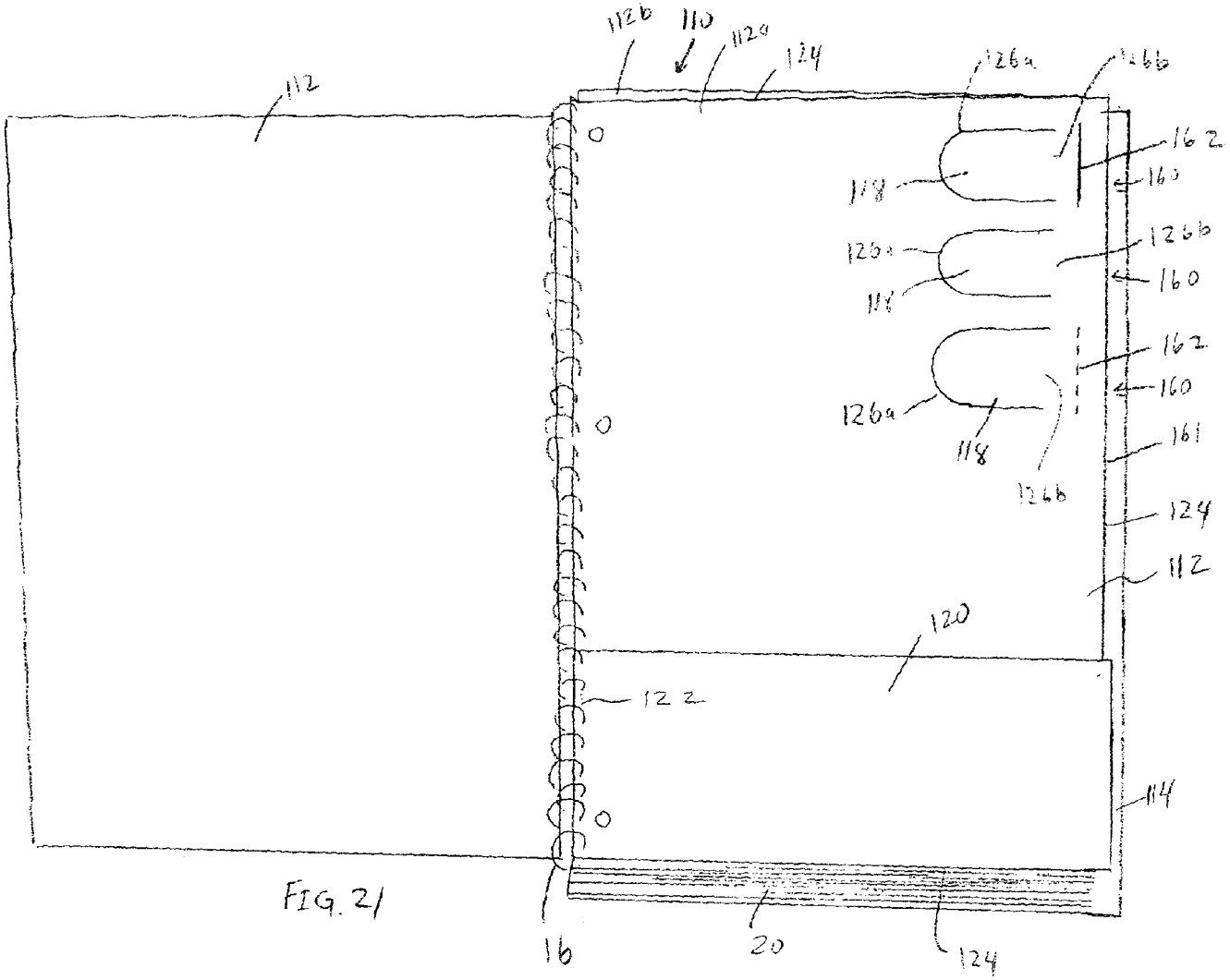
FIG. 21 is a front view of divider pocket, bound to a bound component, showing various selectively deployable tabs in their retracted positions.

FIG. 16 illustrates a bound component 110, with covers/dividers 112, 114 and associated identifier tabs 118. The embodiment shown in FIG. 16 may be similar in function and structure to the bound component 10, the covers/dividers 112, 114, and the binder attachment tabs 18 described above. For example, each identifier tab 118 may be formed within an associated cover/divider 112, with a weakened, or entirely pre-cut, boundary line 126*a* and a non-weakened/non-cut boundary portion/fold line 126*b*. In some cases, the fold line 126*b* can be formed by a fold line or the like, or be visible, as shown in FIG. 16. In other cases the fold line 126*b* can be defined by an imaginary line extending between the endpoints of the boundary line 126*a*, and may not be visible, as shown in FIG. 21. In some cases the fold line 126*b* could be weakened (such as being pre-folded therealong), but not to the same extent as the cut or weakened boundary line 126*a*.

Each identifier tab 118 may be able protrude outwardly and/or be written or printed upon by a user, receive a sticker/label, etc., to enable organization/identification (e.g., by subject or topic) of a given section of a bound component 110. Further, since the primary function of a identifier tab 118 may not be one of attachment, each identifier tab 118 may in some cases lack a tab hole 25 or tab hole punch-out area, although a tab hole 25 or tab hole punch area could be utilized if desired.

To ensure proper use and to be readily viewable by a user, each identifier tab 118 may be positioned and deployable proximate a free (i.e., non-bound) edge 124 of a particular cover/divider 112, opposite a bound edge 122 in one case. In the embodiment of FIG. 16, each identifier tab 118 is positioned adjacent a (side) free edge 124 opposite the binding mechanism 16, but if desired one or more identifier tabs 118 could be positioned adjacent the other (upper and lower) free edges 124.

Each identifier tab 118 may be initially defined by the boundary line 126*a* and/or fold line 126*b*. A side slit/opening 162 may be positioned on the face or major surface/panel of the cover/divider 112 and positioned adjacent to the free edge 124 and adjacent an associated identifier tab 118. In one case the slit/opening 162 is positioned between the free edge 124 and the tab 118 and/or the associated fold line 126*b*. It should be understood that each slit 162 may be a pre-formed slit extending entirely through the associated material of the cover/divider 12. Alternatively, as shown in the bottom-most tab 118 of FIG. 21, the slit 162 can take the form of an area or line of weakness (e.g., perforations) that are tearable to form a slit or opening. When the slit 162 is defined by a tearable line, this configuration can help keep the slit 162 closed during manufacture and handling, reducing the chances of the slit 162 being caught or torn. However, such configuration requires the user to fully open the slit 162 before it can be used, and therefore in other cases the entirely pre-formed slit 162 may be desired to be used.

Each slit 162 may have a height (extending parallel to the fold line 126*b*, in one case) generally equal to, and/or slightly greater than, a height of the associated identifier tab 118 to closely receive the tab 118 therethrough. However, in some cases each slit 162 may have a greater height, particularly when the slit 162 is defined by a tear guideline, in which case the user may be able to tear along the tear guideline the desired amount to define a slit 162 of the desired height/length.

Each identifier tab 118 may be movable between an extended or deployed position, wherein at least part of the tab 118 protrudes beyond the associated free edge 124 (as shown by the upper two tabs 118 in FIG. 16), and a retracted position wherein the tab 118 does not protrude beyond the associated free edge 124 (as shown by the lower tab 118 in FIG. 16). When in the retracted position the identifier tab 118 may neatly fit back the boundary defined by the lines 126*a*, 126*b*, and may be positioned such that no portion of the tab 118 extends past the associated free edge 124. When in either the extended or the retracted position, the identifier tab 118 may be in a plane that is generally parallel to a plane of the body of the cover/divider 112.

The non-weakened boundary portion 126*b* provides or defines a pivot line or fold line about which the tab 118 is movable or pivotable as the tab 118 moves between the extended position and the retracted position. The fold line 126*b* also delineates the tab 118 from a body of the cover/divider 112. The fold line 126*b* can extend generally parallel to the binding device 16 and/or associated slit 162 and/or associated free edge 124.

Each tab 118 may be able to be moved to its extended configuration in last least two manners. For example, the upper identifier tab 118 in FIG. 16 illustrates the tab 118 after it has been folded upwardly/outwardly away from the body of the cover/divider 112, and then tucked through the opening 162 such that a distal portion of the tab 118 is positioned below the cover/divider 112. Alternatively, the identifier tab 118 can be folded in an opposite direction. In particular, in order to provide the configuration of the middle identifier tab 118 in FIG. 16, the tab 118 is first folded downwardly/inwardly below the body of the cover/divider 112, and then passed through the opening 162 such that a distal portion of the tab 118 is positioned above the cover/divider 112. Each identifier tab 118 may be able to be manipulated in either manner to suit the desires of the user. In this particular embodiment, the cover/divider 112 is a single ply component, and the slit 162 is formed entirely through the thickness of the cover/divider 112.

In some cases, instead of or in addition to including the slit 162, the cover/divider 112 may include an end slit 160 at its outer edge 161, as shown, for example, in FIGS. 17-22. In some cases, for example, the cover/divider 112 can be made from a two-ply material 112*a*, 112*b*, which plies 112*a*, 112*b* are joined/folded along outer edge 161. In this case the slit 160 can be positioned along the fold line/outer edge 161, and both plies 112*a*, 112*b* can be coupled to the binding mechanism 16 at their inner edges. When utilized, the slit 160 can either be a pre-formed slit/opening, or defined by a line or area of weakness, tear guideline, etc. as outlined above.

Figures 17, 18, 19, 20:
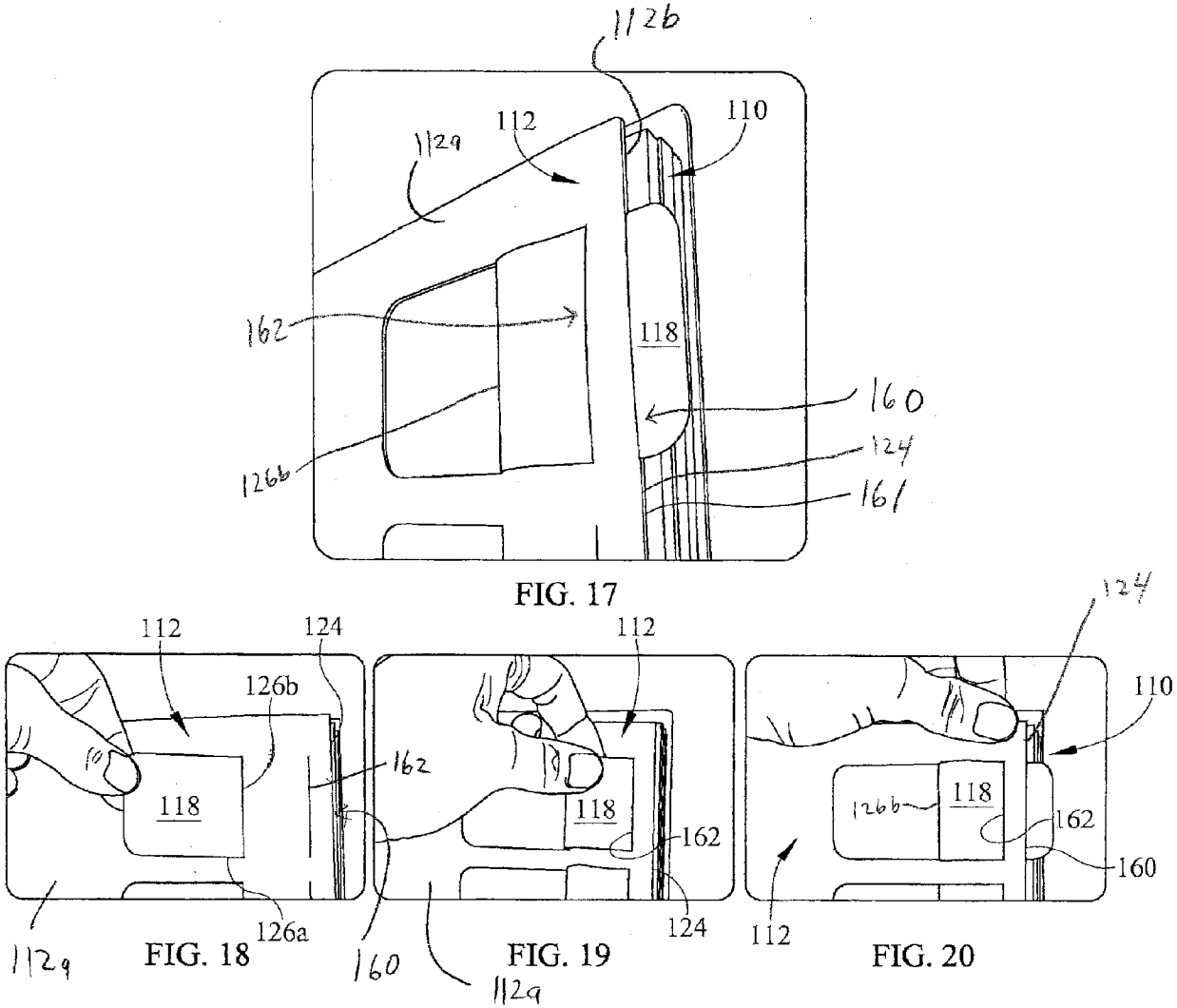
FIG. 17 is a detail side perspective view of the upper deployed tab of the bound component of FIG. 16.
FIGS. 18-20 illustrate a series of steps showing a selectively deployable tab being moved from its retracted to its deployed position.

As shown in FIG. 18, in order to move an identifier tab 118 from the retracted to the deployed position, the tab 118 may first be punched out or otherwise separated from the associated boundary line 126*a*, if necessary. Upon separation, as seen in FIG. 19, the identifier tab 118 may be folded outwardly and inserted through the corresponding interior slit 162, from the outer side of the cover/divider 112, thereby extending below the outer ply 112*a* of cover/divider 112 and out of view. Finally, as shown in FIG. 20, the identifier tab 118 may be inserted through the edge slit 160, allowing the distal end of the identifier tab 118 to protrude beyond the associated free edge 124 and be visible. By being fed through two slits 160, 162, the identifier tab 118 is stably positioned, thereby staying in a deployed position and better resisting tearing during gripping and use (for example, gripping the tab 118 while turning/pivoting the cover/divider 112 and associated stack of pages 20). Alternatively, if the cover/divider 112 is a single-ply, unfolded cover/divider 112, edge slit 160 may be omitted and the interior slit 162 employed alone (as shown in FIG. 16). Further alternatively, a second interior slit 162 (not shown), closer to the free edge 124, could be provided and used similar to an edge slit 160.

Figure 22:
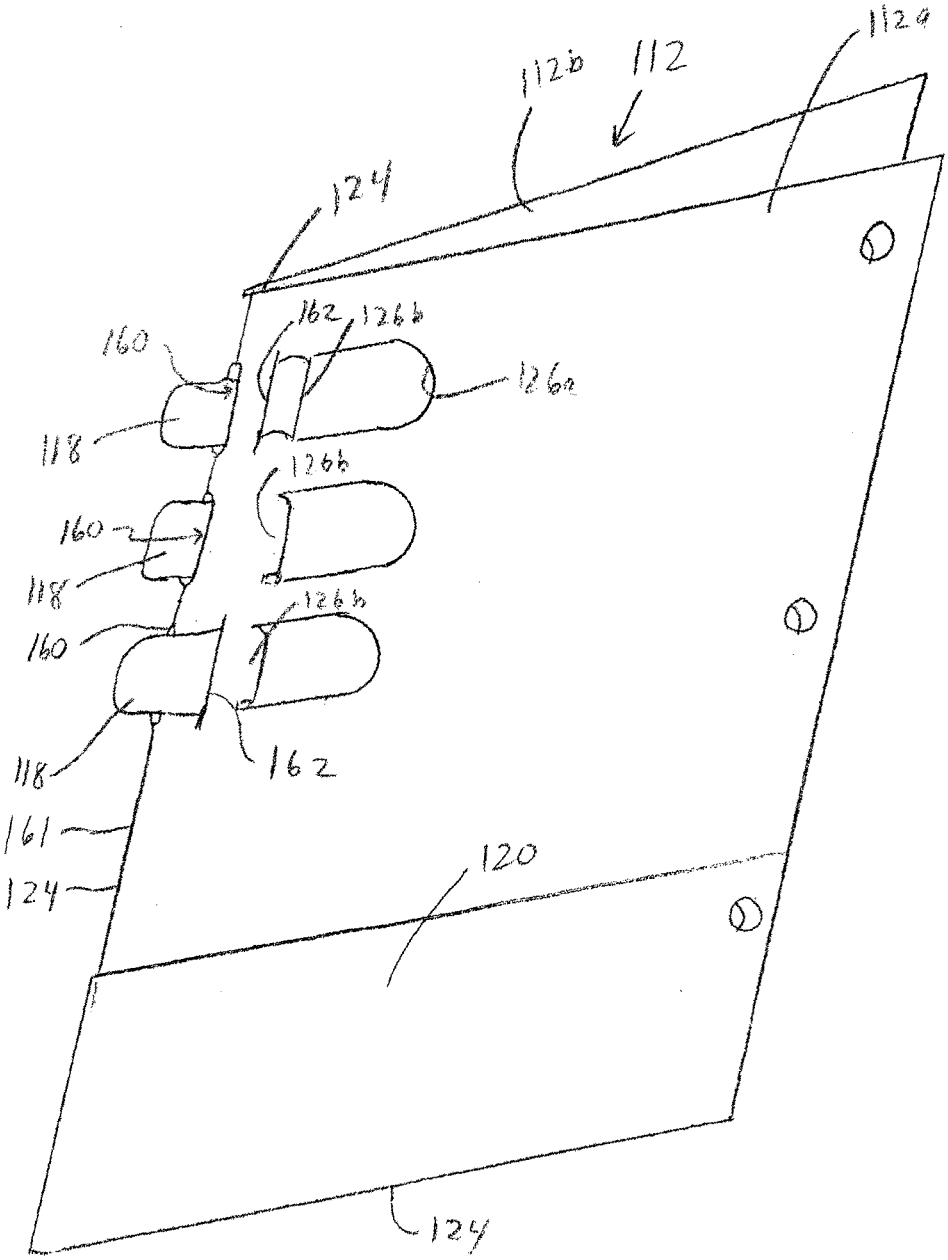
FIG. 22 is a front perspective view of a mirror image of the divider pocket of FIG. 21, separated from the bound component and showing the deployable tabs in various extended positions.

FIGS. 21 and 22 illustrate a further variant (with FIG. 22 being a mirror image of FIG. 21), in which the cover/divider 112 takes the form of a pocket divider made of a two ply material with two sheets 112*a*, 112*b*, folded along outer edge 161. Each sheet 112*a*, 112*b* has a pocket panel 120 carried thereon, and can be bound to or part of a bound component 110 via binding mechanism 16. FIG. 21 illustrates three different embodiments of the tab 118. The upper tab 118 in FIG. 21 utilizes two slits 160, 162 and thus is similar to the embodiment shown in FIGS. 17-20. The middle tab 118 in FIG. 21 utilizes only the edge slit 160 and lacks the side slit 162. The lower tab 118 in FIG. 21 utilizes both slits 160, 162, but the slit 162 initially takes the form a tear guideline.

FIG. 21 shows the tabs in their retracted or undeployed positions, and FIG. 22 shows the tabs 118 of FIG. 21 in their deployed or extended positions. The upper tab 118 of FIG. 22 is moved to its extended position as shown in FIGS. 18-20 and described above. The middle tab 118 of FIG. 22 is folded inwardly and extends through the end slit 160. The middle tab 118 lacks the side slit 162 and therefore the end slit 160 must be utilized to enable the middle tab 118 to be moved to its extended position. However, it should be understood that the upper or lower tabs 118 of FIGS. 21 and 22 (or any tab 118 configuration utilizing an end slit 160) could also be utilized in this manner. The lower tab 118 of FIG. 22 shows the associated slit 162 fully formed or torn, with the tab 118 extending therethrough, but not passing through the end slit 160. Thus, use of the end slit 160 (when a side slit 162 is provided) is optional, which provides options to a user should the end slit 160 be inaccessible or difficult to reach.

Figure 23:
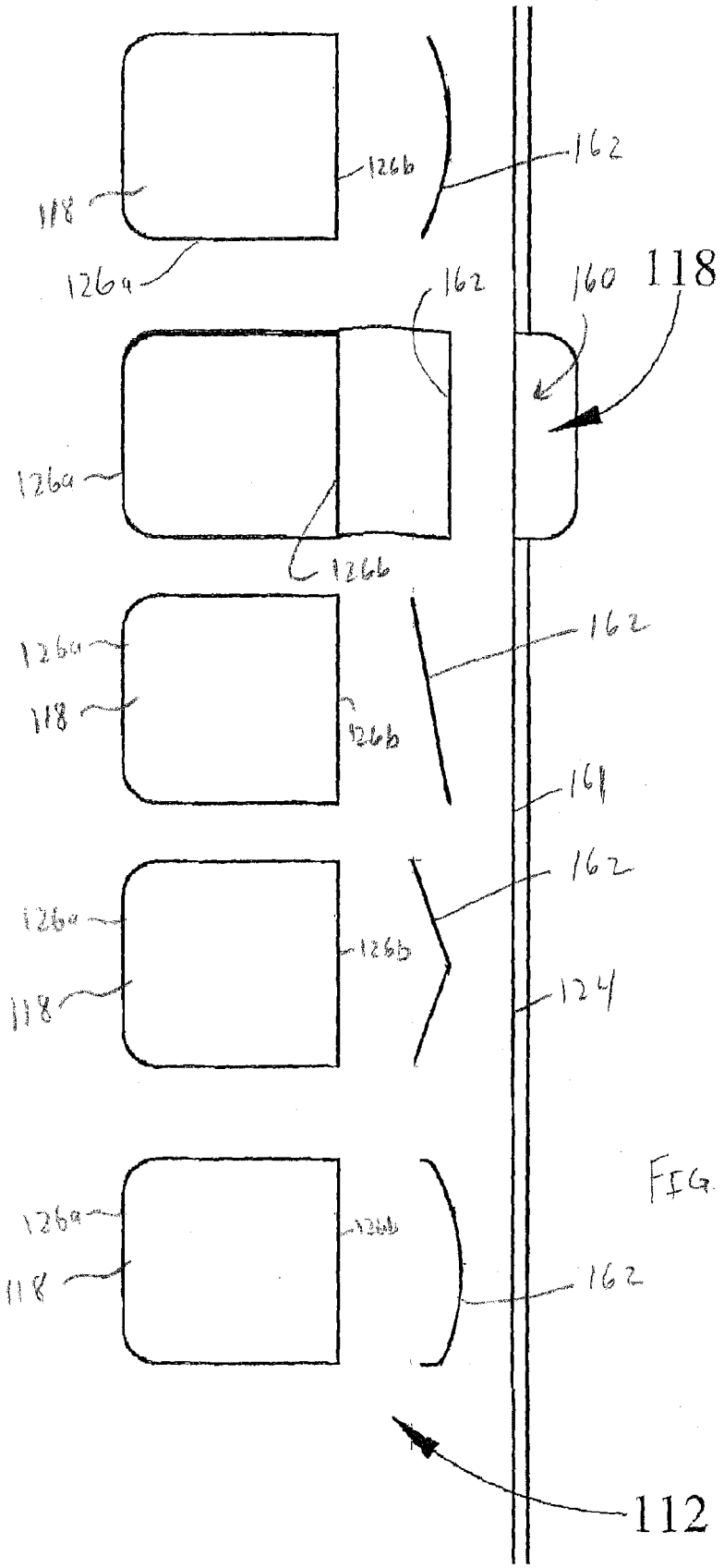
FIG. 23 is a front detail view of various deployable tabs, showing different slit configurations.
Figure 24:
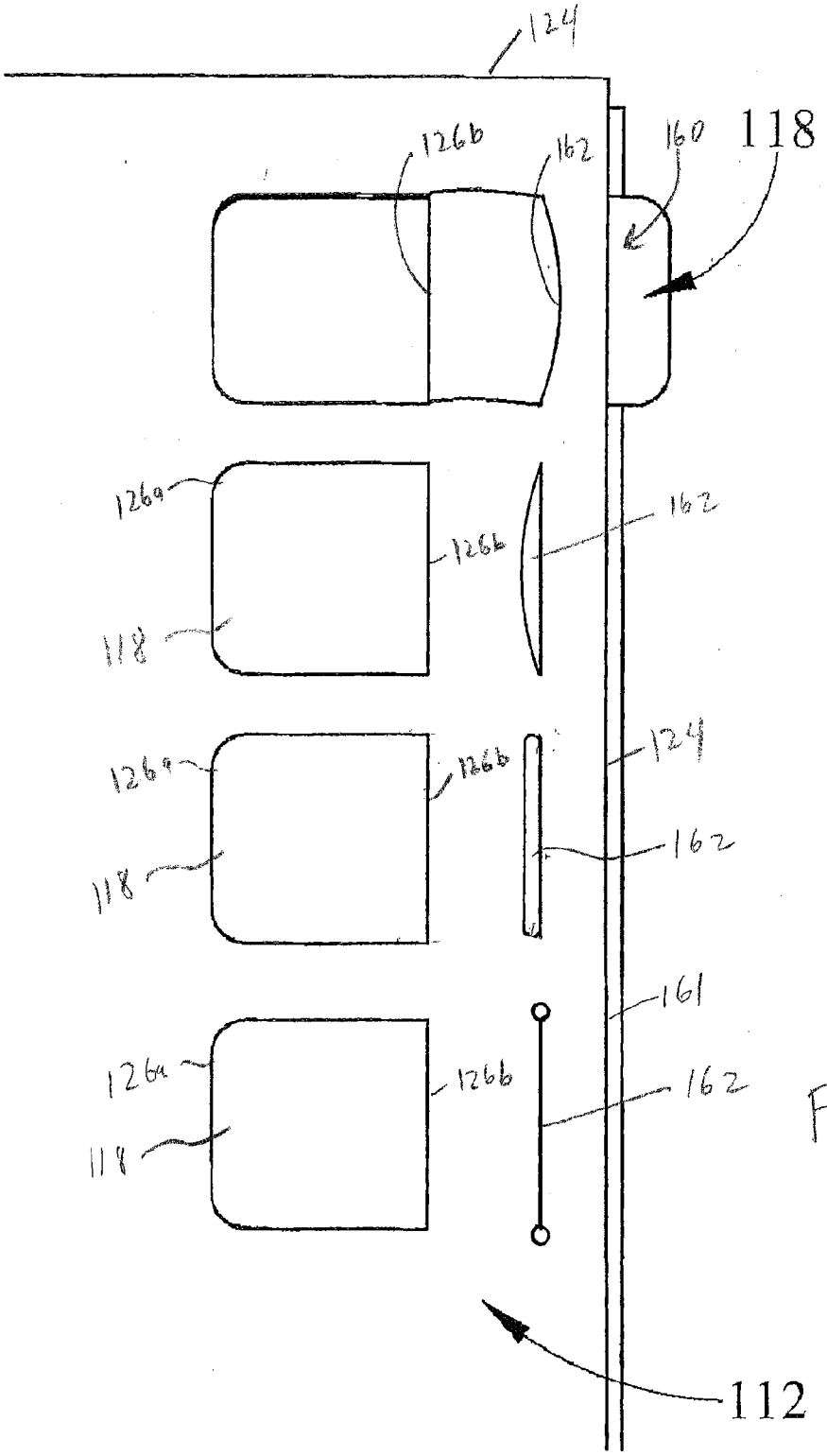
FIG. 24 is a front detail view of various deployable tabs, showing even more slit configurations.

The slits 162 can take any of a variety of shapes and configurations. In particular certain shapes of the slits 162 can aid in manufacturing and user access by, for example, ease of insertion and/or retraction of the tabs 118. FIG. 23 illustrates various shapes of the slits 162 which can be utilized. In addition, as noted above, rather than taking the form of cuts in the material of the cover/divider 112, the slits 160, 162 can be formed by the removal of material, or a combination of slit-cuts and the removal of material. FIG. 24 illustrates various additional configurations of the slits 162 in which some material may be removed.

It should be understood that other types of folders, dividers, pockets, covers, etc. may utilize the tabs described and shown herein. The tabs may be treated to improve their ability to accept writing thereon, be structurally strengthened or have materials added thereto to change their properties as desired. For example, clips, covers, or pieces of polymer or other material, which can be transparent, clear, translucent or opaque, can be positioned on any of the tabs described above to protect the tabs or the content written on the tabs, to hold slips of paper over the tabs, etc.

Figure 26:
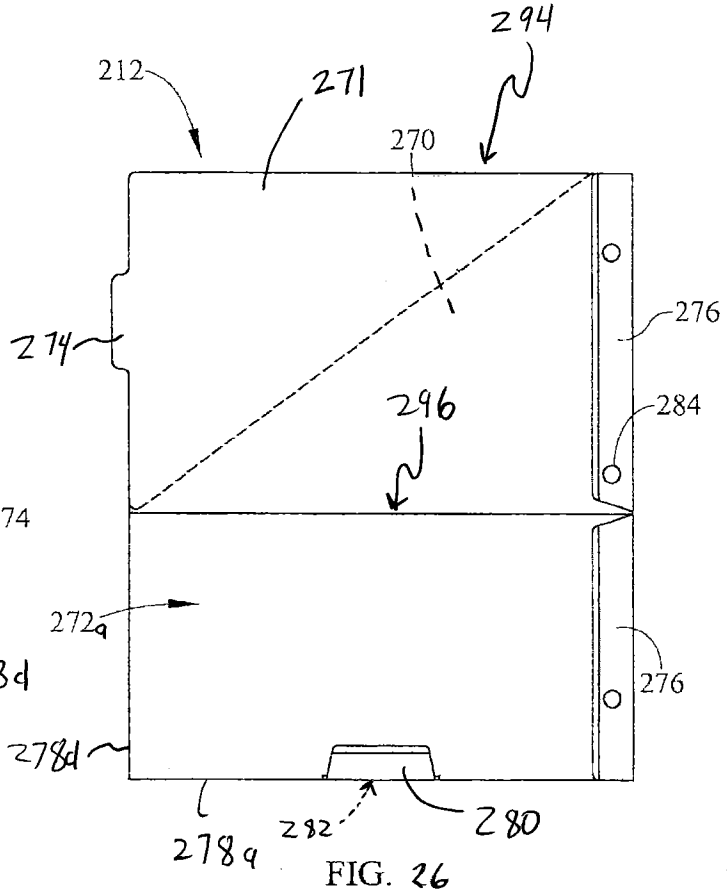
FIG. 26 is a back view of the middle folder of FIG. 25.
Figure 25:
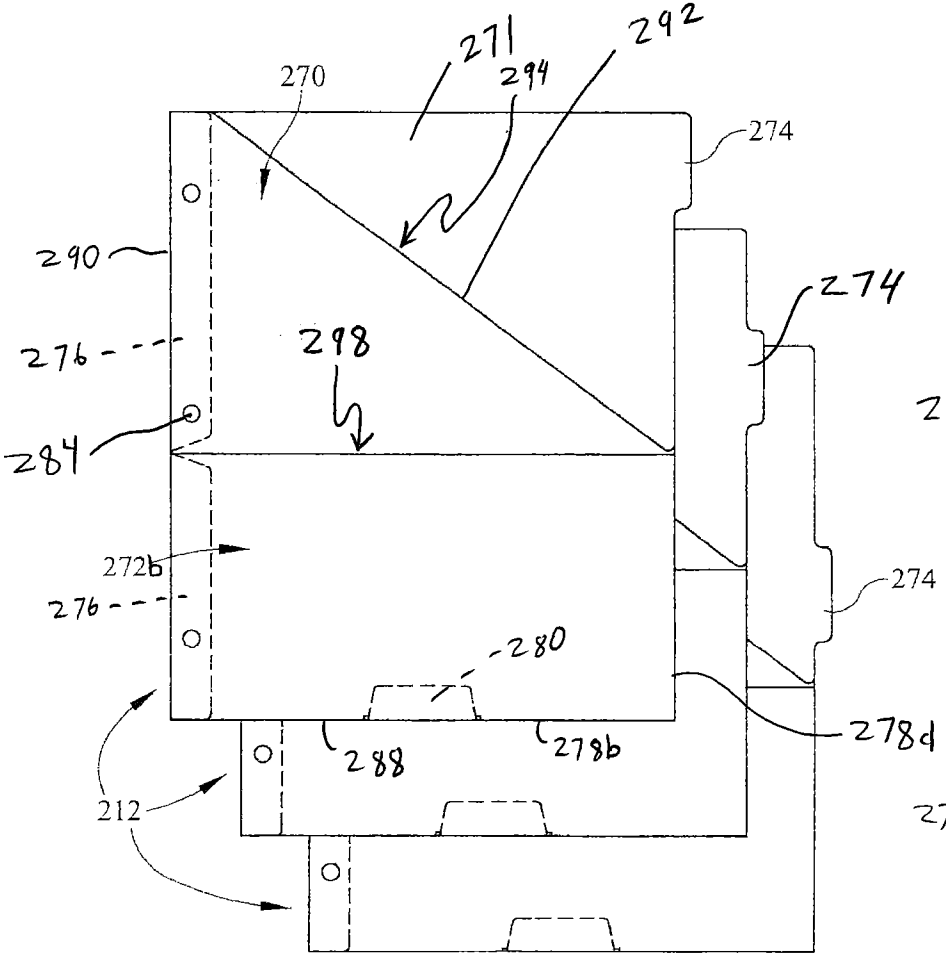
FIG. 25 is a front view of three multi-pocket folders.
Figure 27:
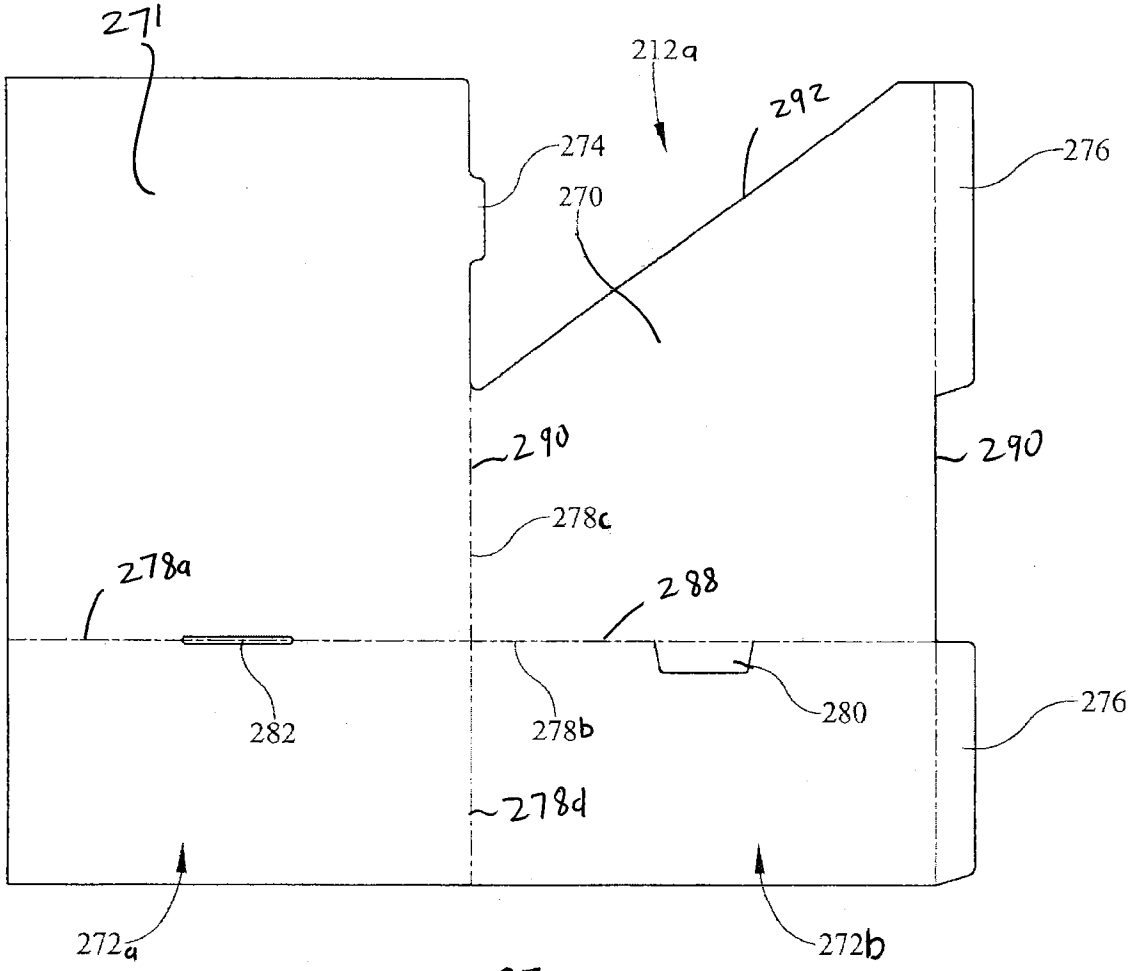
FIG. 27 is a top view of an unassembled blank which can be used to form the folder of FIG. 26.

FIGS. 25-27 illustrate a divider, pocket or folder 212 (collectively termed a "folder" herein), in particular a multi-pocket or three-pocket folder. The folder 212 of FIG. 26 (which corresponds to the middle folder of FIG. 25, which is identical to the other two folders of FIG. 25 except for the location of the tab 274) can be made from the blank 212*a* of FIG. 27. In one case the blank 212*a* of FIG. 27 is in the form of a single sheet of material (e.g., polypropylene or paperboard, or other materials as described above for the covers 12, 14) and may include a main panel or first main panel 271, a second main panel or slash panel 270, and first and second outer panels or pocket panels 272*a*, 272*b*.

The blank 212*a* can have various crease/fold lines 278 to permit the necessary folding to form the folder 212. In particular, the main panel 271 and first outer panel 272*a* are coupled along a first fold line 278*a* that extends therebetween. The slash panel 270 and second outer panel 272*b* are coupled along a second fold line 278*b* that extends therebetween and is parallel to and aligned with the first fold line 278*a*. The main panel 271 and the slash panel 270 are coupled along a third fold line 278*c* that extends therebetween and is perpendicular to the first 278*a* and second 278*b* fold lines. The first outer panel 272*a* and the second outer panel 272*b* are coupled along a fourth fold line 278*d* that extends therebetween and is parallel to and aligned with the third fold line 278*c*.

The main panel 271 and outer panels 272*a*, 272*b* can be generally rectangular, and the slash panel 270 may not be rectangular in some cases. In particular, the slash panel 270 can have a bottom edge 288 (coincident with the second fold line 278*b*), a pair of opposed parallel side edges 290 oriented perpendicular to the bottom edge 288 (one of which is coincident with the third fold line 278*c*), and an upper edge 292, at least part of which in one case extends at an acute or non-perpendicular angle, or is oriented in a non-parallel manner, relative to the bottom edge 288. The main panel 271 and slash panel 270 are joined along the third fold line 278*c* that is coincident with the inner side edge 290, and the upper edge 292 moves away from the bottom edge 288 in a direction moving away from the third fold line 278*c*. In this manner the slash panel 270 can have a surface area smaller than that of the main panel 271 to provide access to a pocket formed therebetween, as will be described in greater detail below. The outer panels 272*a*, 272*b* can each have a surface area smaller than that of the main panel 271 and slash panel 270 to provide access to their associated pockets, as will be described in greater detail below.

The blank 212*a* may further include at least one integrally formed tab 274 (e.g., permanently positioned, as shown, or selectively deployable like an identifier tab 118 described above) positioned along an outer edge of the main panel 271 and extending toward the slash panel 270. The blank 212*a* may also include a pair of sealable integrally formed side flaps 276 coupled to the slash panel 270 and second outer panel 272*b*, respectively, in the illustrated embodiment, and extending outwardly therefrom. The blank 212*a* also includes a bottom closure tab 280 formed by a series of cuts in the second outer panel 272*b* and bounded by the second fold line 278*b*. The blank may further have a tab slit 282 formed along the first fold line 278*a*. The bottom closure tab 280 may be, e.g., die-cut or otherwise readily deployable from the second outer panel 272*b*, in much the same manner as tabs 18, 118 described above.

As shown in FIGS. 25 and 26, once the folder 212 is formed from the blank 212*a*, an inner face of the slash panel 270 faces an inner face of the main panel 271, forming a first pocket 294 therebetween. The first outer panel 272*a* faces and forms a second pocket 296 with the outer face of the main panel 271 and the second outer panel 272*b* faces and forms a third pocket 298 with the outer face of the slash panel 270. In order to close the bottom edge/define a bottom of the first pocket 294 to stop papers and other components from falling out of the first pocket 294, and to secure the folder 212 in place, the bottom closure tab 280 can span the bottom of the first pocket 294 and be secured in place, for example coupled to the first outer panel 272*a*. The tab 280 can extend along a bottom of the first pocket 294 a distance less than an entire length thereof. Thus the first pocket 294 can in one case be open along a bottom edge of the folder 212 except for where the tab 280 is positioned. For example in one case the closure tab 280 can be inserted through the related tab slit 282 to permit placement of the bottom closure tab 280 against the first outer panel 272*a*, or secured against an outer surface of the first outer panel 272*a* as shown in FIG. 26. Once in place, the bottom closure tab 280 can be sealed to the first outer panel 272*a*, thereby helping hold the bottoms of the second 296 and third 298 pockets together, providing a bottom surface to the first pocket 294 and making the divider 212 more stable.

In this manner each pocket 294, 296, 298 is at least partially sealed/closed along at least three edges, and can be made of panels having differing sizes/shapes to provide manual access to the pockets 294, 296, 298. Each pocket 294, 296, 298 can have a size less than a size of the main panel 271, and the first pocket 294 can be larger than the second 296 and third 298 pockets which can have the same size. The sealable side flaps 276 can also be secured in place (e.g., heat-welded and/or adhesively-bonded) to the main panel 271 and first outer panel 272*a* if desired. If desired punched holes 284 can be provided for mounting/binding the folder 212. It is to be understood that such a divider 212 could be made to any desired size and/or that the shape of the pockets 294, 296, 298 could be adjusted according to the desired use.

Having described the invention in detail and by reference to the various embodiments, it should be understood that modifications and variations thereof are possible without departing from the scope of the invention.

What is claimed is:

1. A folder comprising:

a main panel having an inner face and an outer face;

a slash panel having an inner face and an outer face, said slash panel being coupled to said main panel such that said inner face of said main panel and said inner face of said slash panel form a first pocket therebetween, wherein said main panel and said slash panel are coupled along a fold line that extends therebetween and defines a first outer edge of said folder, and wherein said main panel and said slash panel are coupled along a second outer edge of said folder positioned on an opposite side of said folder relative to first outer edge;

a first outer panel coupled to said main panel and forming a second pocket with said outer face of said main panel; and a second outer panel coupled to said slash panel and forming a third pocket with said outer face of said slash panel, wherein said main panel, said slash panel, said first outer panel and said second outer panel are all made from a single unitary piece of material.

2. The folder of claim 1 said slash panel has a surface area less than a surface area of said main panel to provide access to said first pocket.

3. The folder of claim 1 wherein said main panel, said first outer panel and said second outer panel are all generally rectangular, and wherein said slash panel is not generally rectangular.

4. The folder of claim 1 wherein said slash panel has a bottom edge, a pair of opposed parallel side edges oriented perpendicular to said bottom edge, and an upper edge, at least part of which is oriented in a non-parallel manner relative to said bottom edge.

5. The folder of claim 4 wherein said main panel and slash panel are joined along said fold line that is coincident with one of said side edges, and wherein said at least part of said upper edge moves away from said bottom edge in a direction moving away from said fold line.

6. The folder of claim 1 wherein each pocket is at least partially closed along at least three edges thereof.

7. The folder of claim 1 wherein each pocket is made of opposing panels having at least one of differing sizes or shapes to provide manual access thereto.

8. The folder of claim 1 wherein each pocket has a size less than a size of said main panel.

9. The folder of claim 1 wherein said first outer panel and said second outer panel are both rectangular and have the same size.

10. The folder of claim 1 wherein said second pocket and said third pocket have the same size, and said first pocket has a larger size than said second and third pockets.

11. The folder of claim 1 wherein said main panel has the largest surface area of said panels, and said slash panel has a surface area less than said main panel but greater than each outer panel.

12. The folder of claim 1 wherein said main panel and said first outer panel are coupled along a first fold line that extends therebetween, said slash panel and said second outer panel are coupled along a second fold line that extends therebetween and is parallel to said first fold line, said main panel and said slash panel are coupled along said fold line that extends therebetween and is perpendicular to said first and second fold lines, and first outer panel and said second outer panel are coupled along a third fold line that extends therebetween and is parallel to said fold line.

13. The folder of claim 1 wherein said first pocket is at least partially closed along at least three sides thereof.

14. The folder of claim 1 wherein a bottom edge of said first pocket is at least partially closed by a tab extending less than an entire length thereof.

15. The folder of claim 14 wherein said tab couples together said main panel and said slash panel.

16. The folder of claim 14 wherein said tab is integrally formed with one of said main panel or said slash panel and is coupled to said other one of said main panel or said slash panel.

17. A folder comprising:

a first main panel;

a second main panel coupled to said first main panel forming a first pocket therebetween, wherein said first main panel and said second main panel are coupled along a fold line that extends therebetween and defines a first outer edge of said folder, and wherein said first main panel and said second main panel are coupled along a second outer edge of said folder positioned on an opposite side of said folder relative to first outer edge;

a first outer panel coupled to said first main panel forming a second pocket with said first main panel; and a second outer panel coupled to said second main panel forming a third pocket with said second main panel, wherein said first main panel, said second main panel, said first outer panel and said second outer panel are all made from a single unitary piece of material.

18. The folder of claim 17 wherein each pocket is at least partially closed along at least three edges thereof.

19. The folder of claim 17 wherein said second main panel has a surface area less than a surface area of said first main panel to provide access to said first pocket.

20. The folder of claim 17 wherein a bottom edge of said first pocket is at least partially closed by a tab extending less than an entire length thereof.

21. The folder of claim 17 wherein said first pocket is at least partially closed along at least three sides thereof.

22. The folder of claim 17 wherein the folder has only three pockets.

23. The folder of claim 17 wherein the folder has no more than four panels as plies in a thickness direction across a majority of a surface area of each outer panel.

24. The folder of claim 17 wherein the first main panel and the second main panel face each other and overlie each other in a thickness direction perpendicular to the first main panel.

25. A folder comprising:

a first main panel;

a second main panel coupled to said first main panel along a side of said folder and forming a first pocket therebetween;

a first outer panel coupled to said first main panel along a bottom of said folder and forming a second pocket with said first main panel;

a second outer panel coupled to said second main panel along a bottom of said folder and forming a third pocket with said second main panel; and a tab positioned at a bottom of said first pocket, wherein said tab is coupled to one of said first main panel or first outer panel at one end thereof, and is coupled to one of said second main panel or said second outer panel at another end thereof and at least partially defining said first pocket.

26. The folder of claim 25 wherein said bottom of said first pocket is at least partially closed by the tab which extends less than an entire length of the first pocket.

27. The folder of claim 25 wherein said tab is coupled to said first outer panel.

28. The folder of claim 25 wherein said first pocket is open along said bottom except for where said tab is positioned.

29. The folder of claim 25 wherein said bottom of said folder is oriented perpendicular to said side of said folder.

30. The folder of claim 25 wherein said first main panel, said second main panel, said first outer panel and said second outer panel are all made from a single unitary piece of material.

31. The folder of claim 25 wherein the tab is coupled to said first main panel and coupled to said second main panel.

* * * * *